US008808040B2

(12) United States Patent
Kuriyagawa et al.

(10) Patent No.: US 8,808,040 B2
(45) Date of Patent: Aug. 19, 2014

(54) OUTBOARD MOTOR CONTROL APPARATUS

(75) Inventors: Koji Kuriyagawa, Saitama (JP); Hiroshi Yamamoto, Saitama (JP); Tomohiro Miyauchi, Saitama (JP); Kazumi Miyashita, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 178 days.

(21) Appl. No.: 13/472,609

(22) Filed: May 16, 2012

(65) Prior Publication Data

US 2012/0295498 A1 Nov. 22, 2012

(30) Foreign Application Priority Data

May 19, 2011 (JP) ..... 2011-112259

(51) Int. Cl.
*B63H 21/22* (2006.01)

(52) U.S. Cl.
USPC ..... 440/1; 440/84; 440/87

(58) Field of Classification Search
USPC ..... 440/1, 84, 87
See application file for complete search history.

(56) References Cited

U.S. PATENT DOCUMENTS

| | | | | |
|---|---|---|---|---|
| 5,122,084 | A | 6/1992 | Lieb et al. | |
| 6,086,510 | A * | 7/2000 | Kadota | 477/107 |
| 2001/0051474 | A1 * | 12/2001 | Matsuda et al. | 440/1 |
| 2008/0293311 | A1 * | 11/2008 | Miguchi | 440/1 |

FOREIGN PATENT DOCUMENTS

JP 3-079496 A 4/1991

* cited by examiner

*Primary Examiner* — Stephen Avila
(74) *Attorney, Agent, or Firm* — Carrier Blackman & Associates, P.C.; Joseph P. Carrier; Jeffrey T. Gedeon

(57) ABSTRACT

In an apparatus for controlling operation of an outboard motor having a shift lever used to change a shift position between an in-gear position that enables driving force of an internal combustion engine to be transmitted to a propeller by engaging a clutch with one of a forward gear and a reverse gear and a neutral position that cuts off transmission of the driving force by disengaging the clutch from the forward or reverse gear, it is configured to detect a throttle opening of the engine; detect a speed of the engine; calculate a change amount of the detected engine speed; and conduct driving force decreasing control to decrease the driving force of the engine based on the detected throttle opening, the detected engine speed and the calculated engine speed change amount.

9 Claims, 6 Drawing Sheets

OUTBOARD MOTOR CONTROL APPARATUS

BACKGROUND OF THE INVENTION

1. Technical Field

An embodiment of the invention relates to an outboard motor control apparatus, particularly to an apparatus for controlling driving force of an internal combustion engine mounted on an outboard motor to mitigate load on the operator caused by manipulating of a shift lever.

2. Background Art

Conventionally, there is proposed a technique of an outboard motor control apparatus to displace a clutch in response to the manipulation of a shift lever by the operator, so that a shift position can be changed between a so-called in-gear position, i.e., forward or reverse position, in which a forward or reverse gear is in engagement and the driving force of an internal combustion engine is transmitted to a propeller, and a neutral position in which the engagement is released and the transmission of the driving force is cut off, as taught, for example, by Japanese Laid-Open Patent Application No. Hei 3(1991)-79496.

In the reference, a contact switch is provided at the shift lever and when a fact that the shift lever is manipulated from the in-gear position to the neutral position and reaches a predetermined manipulation position is detected through the switch, the ignition cut-off of the engine is carried out to start driving force decreasing control. It makes easy to release the engagement of the clutch with the forward or reverse gear (in-gear condition), thereby mitigating burden or load on the operator caused by the shift lever manipulation.

SUMMARY

However, in the case where the configuration of the reference is applied, since it is difficult to accurately install the switch at the shift lever and its operating point is often not appropriately set, the driving force decreasing control is not started at the right timing, disadvantageously. Further, a space for the installation of the switch is required, so that the degree of freedom of layout is limited.

An object of an embodiment of this invention is therefore to overcome the foregoing problem by providing an outboard motor control apparatus that can decrease driving force of an internal combustion engine at the appropriate timing, thereby mitigating the load on the operator caused by the shift lever manipulation, while enhancing the degree of freedom of layout.

In order to achieve the object, the embodiments of the invention provide in the first aspect an apparatus for controlling operation of an outboard motor having a shift lever used to change a shift position between an in-gear position that enables driving force of an internal combustion engine to be transmitted to a propeller by engaging a clutch with one of a forward gear and a reverse gear and a neutral position that cuts off transmission of the driving force by disengaging the clutch from the forward or reverse gear, comprising: a throttle opening detector adapted to detect a throttle opening of the engine; an engine speed detector adapted to detect a speed of the engine; an engine speed change amount calculator adapted to calculate a change amount of the detected engine speed; and a driving force decreasing controller adapted to conduct driving force decreasing control to decrease the driving force of the engine based on the detected throttle opening, the detected engine speed and the calculated engine speed change amount.

In order to achieve the object, the embodiments of the invention provide in the second aspect a method for controlling operation of an outboard motor having a shift lever used to change a shift position between an in-gear position that enables driving force of an internal combustion engine to be transmitted to a propeller by engaging a clutch with one of a forward gear and a reverse gear and a neutral position that cuts off transmission of the driving force by disengaging the clutch from the forward or reverse gear, comprising the steps of: detecting a throttle opening of the engine; detecting a speed of the engine; calculating a change amount of the detected engine speed; and conducting driving force decreasing control to decrease the driving force of the engine based on the detected throttle opening, the detected engine speed and the calculated engine speed change amount.

BRIEF DESCRIPTION OF DRAWINGS

The above and other objects and advantages of an embodiment of the invention will be more apparent from the following description and drawings in which.

DESCRIPTION OF EMBODIMENT

An outboard motor control apparatus according to an embodiment of the present invention will now be explained with reference to the attached drawings.

Figure 1:
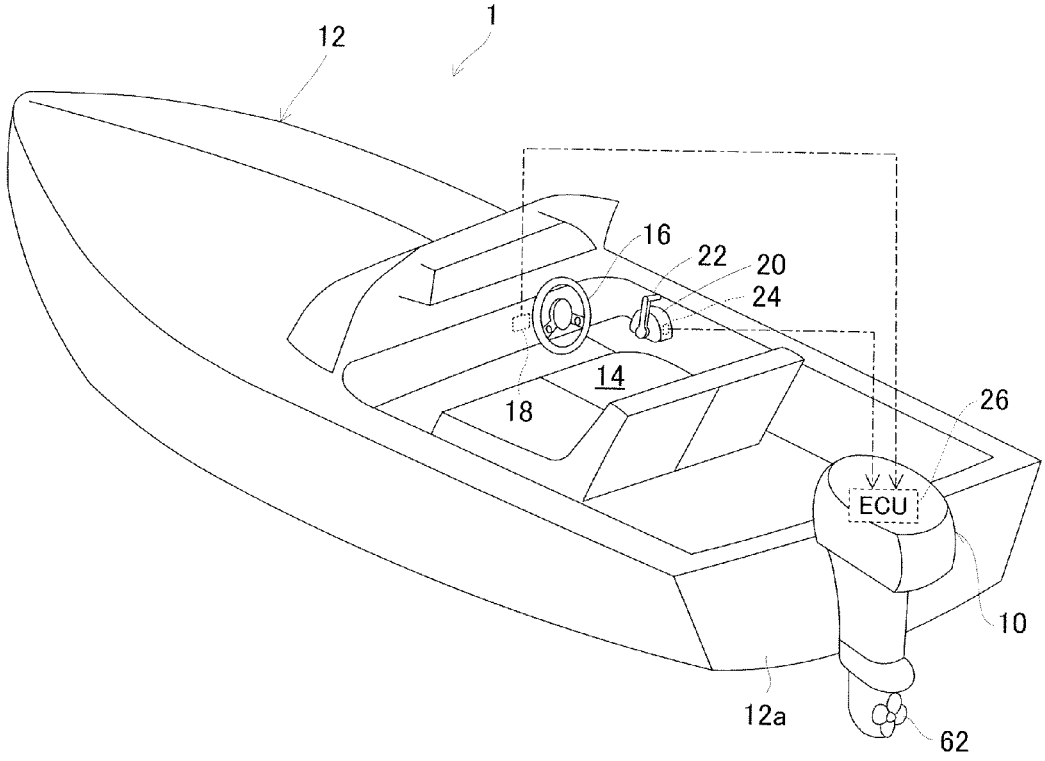
FIG. 1 is an overall schematic view of an outboard motor control apparatus including a boat according to an embodiment of the invention.
Figure 2:
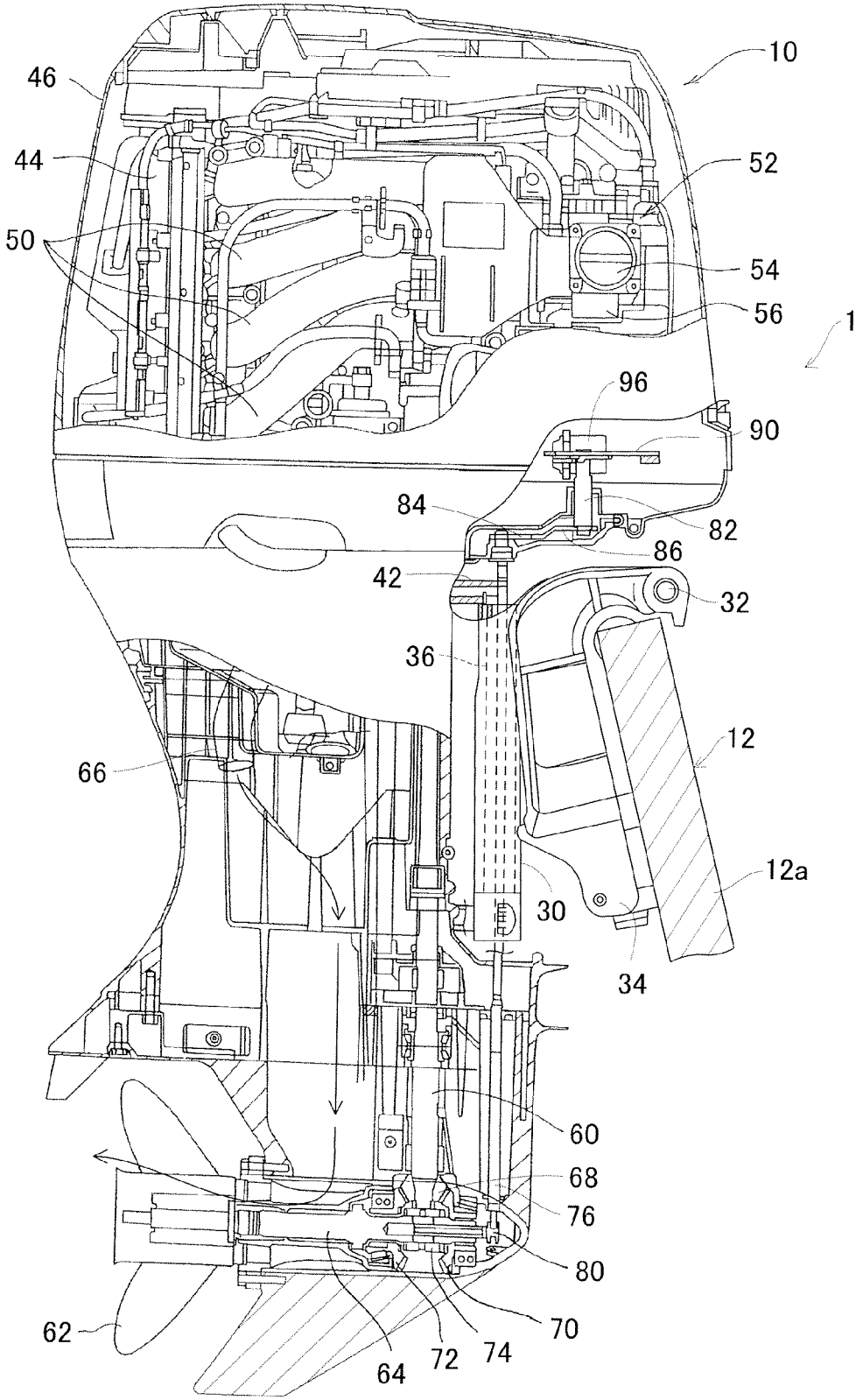
FIG. 2 is an enlarged sectional side view partially showing the outboard motor shown in FIG. 1.

FIG. 1 is an overall schematic view of an outboard motor control apparatus including a boat according to an embodiment of the invention. FIG. 2 is an enlarged sectional side view partially showing the outboard motor shown in FIG. 1 and FIG. 3 is an enlarged side view of the outboard motor.

Figure 3:
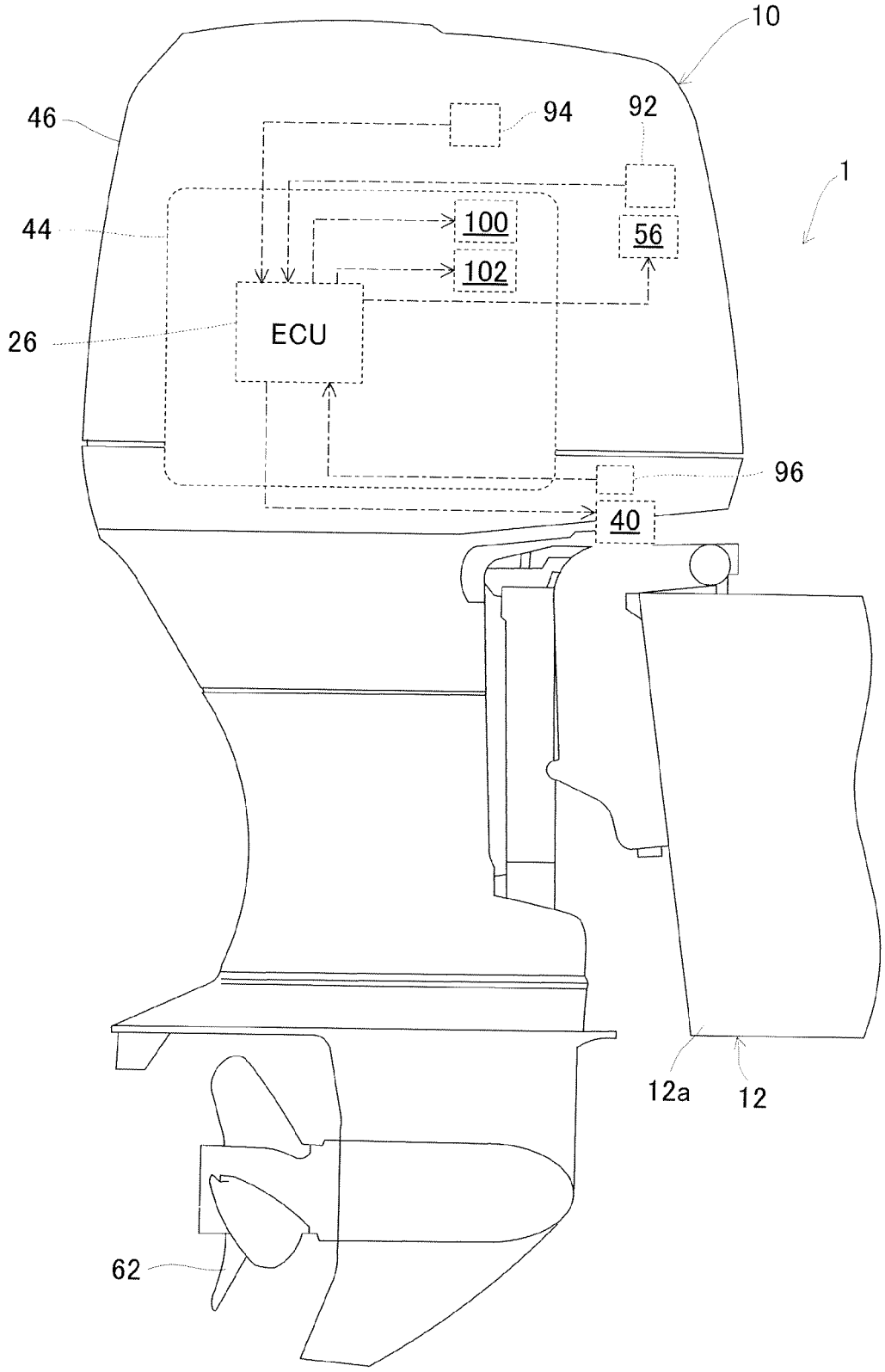
FIG. 3 is an enlarged side view of the outboard motor shown in FIG. 1.

In FIGS. 1 to 3, symbol 1 indicates the boat or vessel whose hull 12 is mounted with the outboard motor 10. The outboard motor 10 is clamped (fastened) to the stern or transom 12*a* of the hull 12.

As shown in FIG. 1, a steering wheel 16 is installed near a cockpit (the operator's seat) 14 of the hull 12 to be manipulated by the operator (not shown). A steering angle sensor 18 is attached on a shaft (not shown) of the steering wheel 16 to produce an output or signal corresponding to the steering angle $\alpha$ applied or inputted by the operator through the steering wheel 16.

A remote control box 20 is provided near the cockpit 14 and is equipped with a shift lever (shift/throttle lever) 22 installed to be manipulated by the operator. The lever 22 can be moved or swung in the front-back direction from the initial position and is used to input a shift change command (forward, reverse and neutral switch command) and an engine speed regulation command including an engine acceleration and deceleration command. A lever position sensor 24 is installed in the remote control box 20 and produces an output or signal corresponding to a position of the lever 22.

The outputs of the steering angle sensor 18 and lever position sensor 24 are sent to an Electronic Control Unit (ECU) 26 disposed in the outboard motor 10. The ECU 26 has a microcomputer including a CPU, ROM, RAM and other devices.

As clearly shown in FIG. 2, the outboard motor 10 is fastened to the hull 12 through a swivel case 30, tilting shaft 32 and stern brackets 34.

An electric steering motor (actuator; only shown in FIG. 3) 40 for driving a swivel shaft 36 which is housed in the swivel case 30 to be rotatable about the vertical axis, is installed at the upper portion in the swivel case 30. The rotational output of the steering motor 40 is transmitted to the swivel shaft 36 via a speed reduction gear mechanism (not shown) and mount frame 42, whereby the outboard motor 10 is rotated or steered about the swivel shaft 36 as a steering axis (about the vertical axis) to the right and left directions.

An internal combustion engine (prime mover; hereinafter referred to as the "engine") 44 having a plurality of (i.e., six) cylinders is disposed at the upper portion of the outboard motor 10. The engine 44 comprises a spark-ignition, V-type, multi(six)-cylinder gasoline engine with a displacement of 3,500 cc. The engine 44 is located above the water surface and covered by an engine cover 46.

An air intake pipe 50 of the engine 44 is connected to a throttle body 52. The throttle body 52 has a throttle valve 54 installed therein and an electric throttle motor (actuator) 56 for opening and closing the throttle valve 54 is integrally disposed thereto.

The output shaft of the throttle motor 56 is connected to the throttle valve 54 via a speed reduction gear mechanism (not shown). The throttle motor 56 is operated to open and close the throttle valve 54, thereby regulating the flow rate of the air sucked in the engine 44 to control the engine speed. The outboard motor 10 is equipped with a power source (not shown) such as a battery attached to the engine 44 to supply operating power to the motors 40, 56, etc.

The outboard motor 10 has a drive shaft 60 that is rotatably supported in parallel with the vertical axis and a propeller shaft 64 that is supported to be rotatable about the horizontal axis and attached at its one end with a propeller 62. As indicated by arrows in FIG. 2, exhaust gas emitted from an exhaust pipe 66 of the engine 44 passes near the drive shaft 60 and propeller shaft 64 to be discharged into the water, i.e., to rearward of the propeller 62.

The drive shaft 60 is connected at its upper end with the crankshaft (not shown) of the engine 44 and at its lower end with a pinion gear 68. The pinion gear 68 is engaged (meshed) with a forward gear (forward bevel gear) 70 and reverse gear (reverse bevel gear) 72 that are rotatably provided, and the forward and reverse gears 70, 72 are rotated in the opposite directions by the pinion gear 68. A clutch 74 is installed between the forward and reverse gears 70, 72 to be rotated integrally with the propeller shaft 64.

The clutch 74 is displaced in response to the manipulation of the shift lever 22. When the clutch 74 is engaged with the forward gear 70, the rotation of the drive shaft 60 is transmitted to the propeller shaft 64 through the pinion gear 68 and forward gear 70, so that the propeller 62 is rotated to generate the thrust acting in the direction of making the hull 12 move forward. Thus the forward position is established.

On the other hand, when the clutch 74 is engaged with the reverse gear 72, the rotation of the drive shaft 60 is transmitted to the propeller shaft 64 through the pinion gear 68 and reverse gear 72, so that the propeller 62 is rotated in the opposite direction from the forward moving to generate the thrust acting in the direction of making the hull 12 move backward (reverse). Thus the reverse position is established.

When the clutch 74 is not engaged with either one of the forward and reverse gears 70, 72, the rotation of the drive shaft 60 to be transmitted to the propeller shaft 64 is cut off. Thus the neutral position is established.

The configuration of the shift position change will be explained in detail. The clutch 74 is connected via a shift slider 80 to the bottom of a first shift shaft 76 that is rotatably supported in parallel with the vertical direction. The upper end of the first shift shaft 76 is positioned in the internal space of the engine cover 46 and a second shift shaft 82 is disposed in the vicinity of the upper end to be rotatably supported in parallel with the vertical direction.

The upper end of the first shift shaft 76 is attached with a first gear 84, while the bottom of the second shift shaft 82 is attached with a second gear 86. The first and second gears 84, 86 are meshed with each other.

A shift arm 90 is fixed to the upper end or thereabout of the second shift shaft 82, and is connected to the shift lever 22 of the hull 12 through a link mechanism, push-pull cable and the like, which are not shown.

As thus configured, upon the manipulation of the shift lever 22 by the operator, the second shift shaft 82 is rotated through the shift arm 90, etc., and the rotation of the shaft 82 is transmitted through the second gear 86 and first gear 84 to the first shift shaft 76 to rotate it. The rotation of the first shift shaft 76 displaces the shift slider 80 and clutch 74 appropriately, thereby switching the shift position among the forward, reverse and neutral positions, as mentioned above.

Thus, the outboard motor 10 is configured so that, in response to the shift lever manipulation by the operator, the shift position is switchable between the in-gear position (i.e., forward or reverse position) that enables the driving force (output) of the engine 44 to be transmitted to the propeller 62 by engaging the clutch 74 with one of the forward and reverse clutches 70, 72, and the neutral position that cuts off the transmission of the driving force.

As shown in FIG. 3, a throttle opening sensor (throttle opening detector) 92 is installed near the throttle valve 54 to produce an output or signal indicative of a throttle opening TH [degree]. A crank angle sensor (engine speed detector) 94 is disposed near the crankshaft of the engine 44 and produces a pulse signal at every predetermined crank angle.

A neutral switch (contact switch) 96 is installed near the second shift shaft 82 and produces an ON signal when the shift position is in the neutral position and an OFF signal when it is in the forward or reverse position, i.e., the in-gear position. The outputs of the foregoing switch and sensors are sent to the ECU 26.

Based on the received sensor outputs, the ECU 26 controls the operation of the steering motor 40 to steer the outboard motor 10. Further, based on the received outputs of the lever position sensor 24, etc., the ECU 26 controls the operation of the throttle motor 56 to open and close the throttle valve 54, thereby regulating the throttle opening TH.

Furthermore, based on the sensor outputs and switch output, the ECU 26 determines the fuel injection amount and ignition timing of the engine 44, so that fuel of the determined fuel injection amount is supplied through an injector 100 (shown in FIG. 3) and the air-fuel mixture composed of the injected fuel and intake air is ignited by an ignition device 102 (shown in FIG. 3) at the determined ignition timing.

Thus, the outboard motor control apparatus according to the embodiment is a Drive-By-Wire type apparatus whose operation system (steering wheel 16, shift lever 22) has no mechanical connection with the outboard motor 10, except the configuration related to the shift position change.

Figure 4:
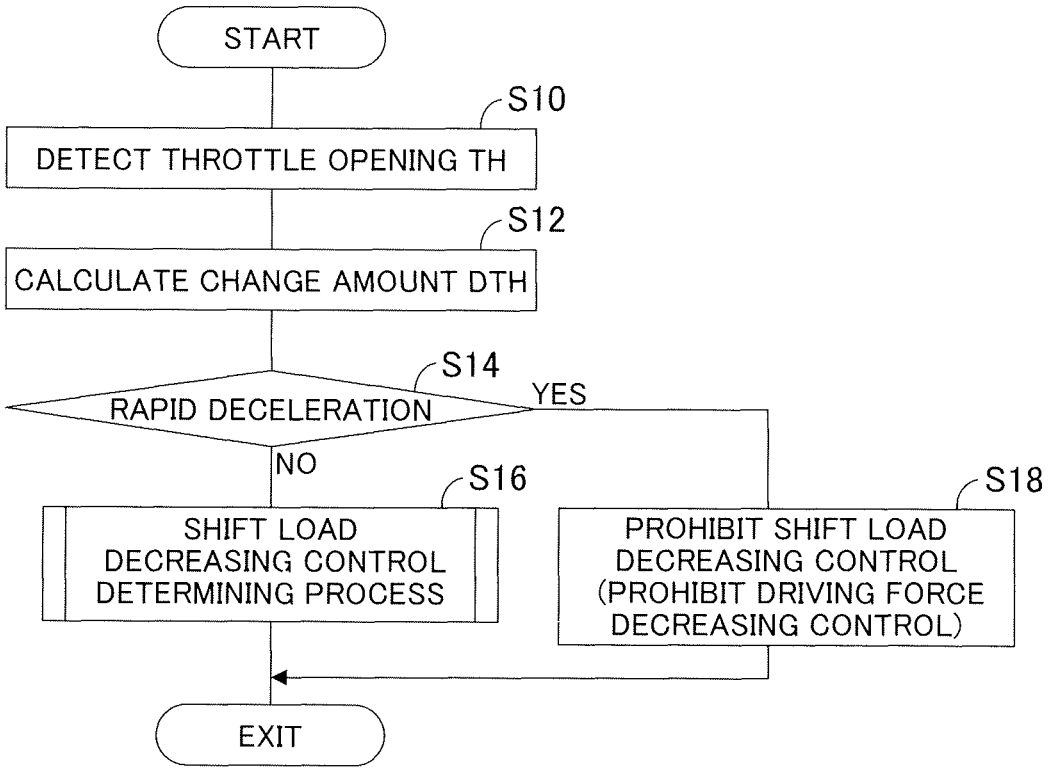
FIG. 4 is a flowchart showing an engine control operation executed by an Electronic Control Unit (ECU) shown in FIG. 1.

FIG. 4 is a flowchart showing an engine control operation executed by the ECU26. The illustrated program is executed at predetermined intervals, e.g., 100 milliseconds.

The program begins at S10, in which the throttle opening TH is detected or calculated from the output of the throttle opening sensor 92 and the program proceeds to S12, in which a change amount DTH of the detected throttle opening TH per a predetermined time period (e.g., 500 milliseconds) is calculated.

Next the program proceeds to S14, in which it is determined whether the deceleration (more precisely, rapid deceleration) is instructed to the engine 44 by the operator, i.e., whether the engine 44 is in the operating condition to (rapidly) decelerate the boat 1, when the shift position is in the forward or reverse position.

Specifically, the throttle opening change amount DTH calculated in S12 is compared to a prescribed value DTHa used for deceleration determination and when the change amount DTH is equal to or less than the prescribed value DTHa, it is discriminated that the throttle valve 54 is operated rapidly in the closing direction, i.e., the rapid deceleration is instructed. The prescribed value DTHa is set as a criterion (negative value) for determining whether the rapid deceleration is instructed, e.g., −20 degrees.

When the result in S14 is negative, the program proceeds to S16, in which a shift load decreasing control determining process is conducted for determining whether the shift load decreasing control that decreases the driving force of the engine 44 for mitigating load on the operator caused by the shift lever manipulation is to be performed.

Figure 5:
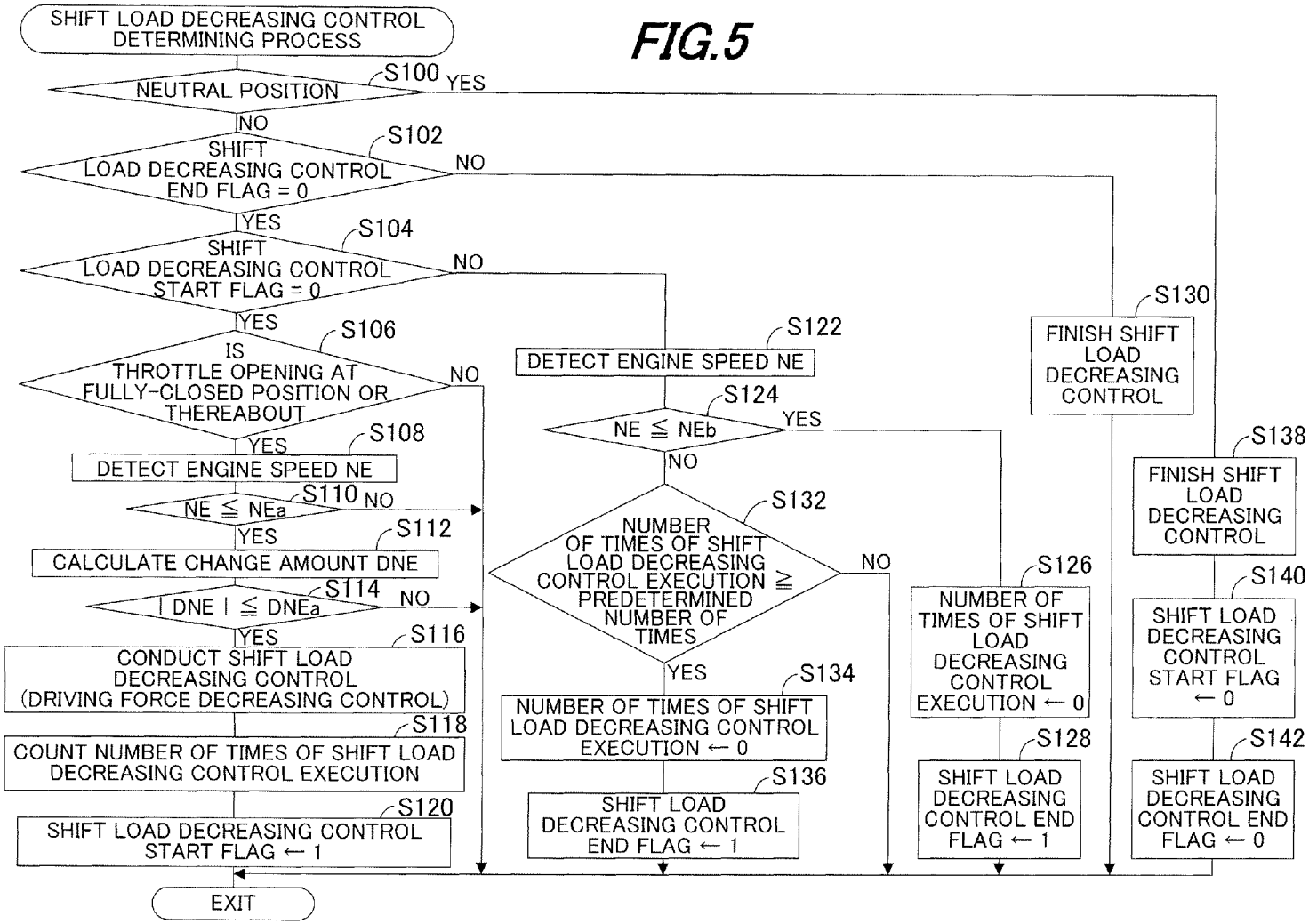
FIG. 5 is a subroutine flowchart showing a shift load decreasing control determining process shown in FIG. 4.

FIG. 5 is a subroutine flowchart showing the process.

As shown in FIG. 5, in S100, it is determined based on the output of the neutral switch 96 whether the present shift position is in the neutral position. When the result in S100 is negative, the program proceeds to S102, in which it is determined whether the bit of a shift load decreasing control end flag is 0.

This flag, whose initial value is 0, is set to 1 when the shift load decreasing control should be finished and otherwise, reset to 0. Accordingly, the result in S102 in the first program loop is generally affirmative and the program proceeds to S104, in which it is determined whether the bit of a shift load decreasing control start flag (described later) is 0.

Since the initial value of this flag is also 0, the result in S104 in the first program loop is generally affirmative and the program proceeds to S106, in which it is determined whether the throttle opening TH is at the fully-closed position (0 degree) or thereabout.

When the result in S106 is negative, the remaining steps are skipped, while when the result is affirmative, the program proceeds to S108, in which the output pulses of the crank angle sensor 94 are counted to detect or calculate the engine speed NE.

Next the program proceeds to S110, in which it is determined whether the detected engine speed NE is equal to or less than a predetermined engine speed NEa. The predetermined engine speed NEa is used as a criterion for determining whether the engine 44 is operated at relatively low speed, e.g., set to 2000 rpm.

When the result in S110 is negative, the remaining steps are skipped, while when the result is affirmative, the program proceeds to S112, in which a change amount DNE of the engine speed NE per a predetermined time period (e.g., 500 milliseconds) is calculated.

Next the program proceeds to S114, in which it is determined whether the engine speed NE is stable, i.e., whether the engine 44 is under the stable operating condition. This determination is made by comparing an absolute value of the change amount DNE with a predetermined value DNEa and when the absolute value is equal to or less than the predetermined value DNEa, the engine speed NE is determined to be stable. The predetermined value DNEa is set as a criterion for determining whether the engine speed NE is stable so that the change amount DNE is relatively small, e.g., set to 300 rpm.

When the result in S114 is negative, the program is terminated, while when the result is affirmative, the program proceeds to S116, in which the shift load decreasing control (sometimes called the "driving force decreasing control") to decrease the driving force of the engine 44 for mitigating load on the operator caused by the manipulation of the shift lever 22, is conducted or started.

The processing of S106 to S116 will be explained in detail. First, based on the throttle opening TH, engine speed NE and engine speed change amount DNE, it is determined whether the shift lever 22 is manipulated by the operator and the shift position is about to be changed from the in-gear position to the neutral position, i.e., whether the engine 44 is in the operating condition of immediately before the engagement of the clutch 74 with the forward or reverse gear 70 or 72 is released.

Specifically, when the throttle opening TH is at the fully-closed position or thereabout, the engine speed NE is equal to or less than the predetermined engine speed NEa and the change amount DNE is equal to or less than the predetermined value DNEa, it is estimated that the shift lever 22 has been manipulated to change the shift position from the in-gear position to the neutral position and, at that timing, the shift load decreasing control is performed.

The shift load decreasing control (driving force decreasing control) is executed by cutting off the ignition, retarding the ignition timing (e.g., 10 degrees) or decreasing the fuel injection amount in the engine 44, i.e., conducting at least one of those operations, to decrease the driving force of the engine 44, more specifically, to change the engine speed NE so as to gradually decrease it. Consequently, it makes easy to release the engagement of the clutch 74 with the forward or reverse gear 70 or 72, thereby mitigating load on the operator caused by the shift lever manipulation.

Note that, in S116, in the case of the ignition cut-off or retarding of the ignition timing, it is carried out from a cylinder associated with the next ignition, while in the case of decrease in the fuel injection amount, it is carried out from a cylinder associated with the next injection.

Further, the shift load decreasing control through the ignition cut-off or the like is conducted with three cylinders out of a plurality of (six) cylinders. To be more specific, in the engine 44 of V-type and having the six cylinders in this embodiment, it is configured so that the above three cylinders with which the shift load decreasing control is to be conducted are those of a cylinder bank containing the specific cylinder with which the control is first conducted. For instance, in the case where the shift load decreasing control is first conducted with a cylinder in the right bank, the control is conducted with three cylinders of the right bank while the other three cylinders in the left bank are operated under the normal control. Further, when the shift load decreasing control is performed by retarding the ignition timing of the right bank, the ignition timing of the left bank may be advanced.

Since the combustion stroke of such a V-type, six-cylinder engine is carried out alternately in the right and left banks, when the three cylinders to be conducted with the shift load decreasing control are defined as mentioned above, the execution and inexecution of the control are also alternately made in the engine 44. As a result, the engine speed NE can be further sharply changed with no time lag, thereby effectively mitigating load on the operator caused by the shift lever manipulation.

In the case where the engine 44 is of in-line, six-cylinder type, the first to sixth cylinders arranged in order are divided into a group including the first to third cylinders and the other group including the fourth to sixth cylinders and three cylinders in one of the two groups are conducted with the shift load decreasing control. Specifically, when the shift load decreasing control is first conducted with the first cylinder for example, three cylinders of one group including the first cylinder are conducted with the control, while the fourth to sixth cylinders in the other group are operated under the normal control (similarly to the aforementioned case, when the ignition timing of the one group including the first to third cylinders is retarded, the ignition timing of the other group including the fourth to sixth cylinders may be advanced). With this, the same effect can be achieved also in the in-line, six-cylinder engine.

Next, the program proceeds to S118, in which the number of times that the shift load decreasing control through the ignition cut-off or the like is executed is counted for each cylinder, and to S120, in which the bit of the shift load decreasing control start flag is set to 1. Specifically, the bit of this flag is set to 1 when the shift load decreasing control is started and otherwise, reset to 0.

In a program loop after the bit of the shift load decreasing control start flag is set to 1, the result in S104 is negative and the program proceeds to S122. In S122, the engine speed NE is detected and then in S124, it is determined whether the detected engine speed NE is equal to or less than a limit value (stall limit engine speed NEb) with which the engine 44 can avoid a stall. The stall limit engine speed NEb is set, for instance, the same as a threshold value used for determining whether a starting mode should be changed to a normal mode in the normal operation control of the engine 44, more exactly, set to 400 rpm.

When the result in S124 is affirmative, the program proceeds to S126, in which a counter value indicating the number of times of the shift load decreasing control execution is reset to 0, and to S128, in which the bit of the shift load decreasing control end flag is set to 1.

When the bit of this flag is set to 1, the result in S102 in the next program loop becomes negative and the program proceeds to S130, in which the shift load decreasing control is finished. Specifically, when the engine speed NE is equal to or less than the stall limit engine speed NEb, if the shift load decreasing control, i.e., the control to decrease the driving force of the engine 44 through the ignition cut-off, etc., is continued, it may cause a stall of the engine 44. Therefore, in this case, the shift load decreasing control is stopped regardless of the shift rotational position.

On the other hand, when the result in S124 is negative, the program proceeds to S132, in which based on the counter value indicating the number of times of the shift load decreasing control execution, it is determined whether the shift load decreasing control (driving force decreasing control) is conducted a predetermined number of times (described later) or more. When the result in S132 is negative, the remaining steps are skipped, while when the result is affirmative (i.e., when the counter value is equal to or greater than the predetermined number of times), the program proceeds to S134, in which the counter value is reset to 0, and to S136, in which the bit of the shift load decreasing control end flag is set to 1. Consequently, the result in S102 in the next program loop becomes negative and the program proceeds to S130, in which the shift load decreasing control is finished.

The processing of S132 to S136 is conducted for preventing the shift load decreasing control from being executed for a long time. Specifically, depending on movement of the shift lever 22, for example when the shift lever 22 is slowly manipulated, the control such as the ignition cut-off is continued for a relatively long time and it could make the operation of the engine 44 (combustion condition) unstable, i.e., the engine speed NE unstable, disadvantageously.

Therefore, the apparatus according to this embodiment is configured to finish (stop) the shift load decreasing control when it is discriminated that the load on the operator caused by the shift lever manipulation has been sufficiently mitigated through the control (more exactly, when about two seconds have elapsed since the control started). The predetermined number of times is set as a criterion for determining whether the load on the operator caused by the shift lever manipulation is sufficiently mitigated and also determining that the engine 44 operation may become unstable when the ignition cut-off, etc., is executed the number of times at or above this value, e.g., set to 10 times.

When the shift lever 22 is manipulated by the operator and the change of the shift position to the neutral position is completely done, the result in S100 is affirmative and the program proceeds to S138, in which the shift load decreasing control is finished and to S140 and S142, in which the bits of the shift load decreasing control start flag and shift load decreasing control end flag are both reset to 0, whereafter the program is terminated.

Returning to the explanation on FIG. 4, when the result in S14 is affirmative, the program proceeds to S18, in which the shift load decreasing control is prohibited, i.e., when the deceleration (precisely, the rapid deceleration) is instructed to the engine 44 by the operator with the shift position being in the forward or reverse position, the above control is not conducted. With this, it becomes possible to prevent occurrence of so-called water hammer that may be caused by suction of water through the exhaust pipe 66.

To be more specific, in the case where the shift lever 22 is swiftly manipulated toward the reverse side (i.e., the (rapid) deceleration is instructed to the engine 44) with the shift position in the forward position (i.e., with the clutch 74 engaged with the forward gear 70), if the driving force is decreased at that time, it makes easy to release the engagement with the forward gear 70 (in-gear condition) and accordingly, the shift position is rapidly changed from the forward position to the reverse position at once.

In this case, the clutch 74 is sometimes engaged with the reverse gear 72 with the propeller 62 still rotating in the forward direction and it may lead to the reverse rotation of the engine 44, so that water is sucked through the exhaust pipe 66. As a result, the water hammer occurs and it may give damages to the engine 44. However, since this embodiment is configured to prohibit the driving force decreasing control as mentioned above, the engagement with the forward gear 70 is not easily released and it makes possible to delay the timing of shift position change to the reverse position, thereby preventing occurrence of the water hammer.

Figure 6:
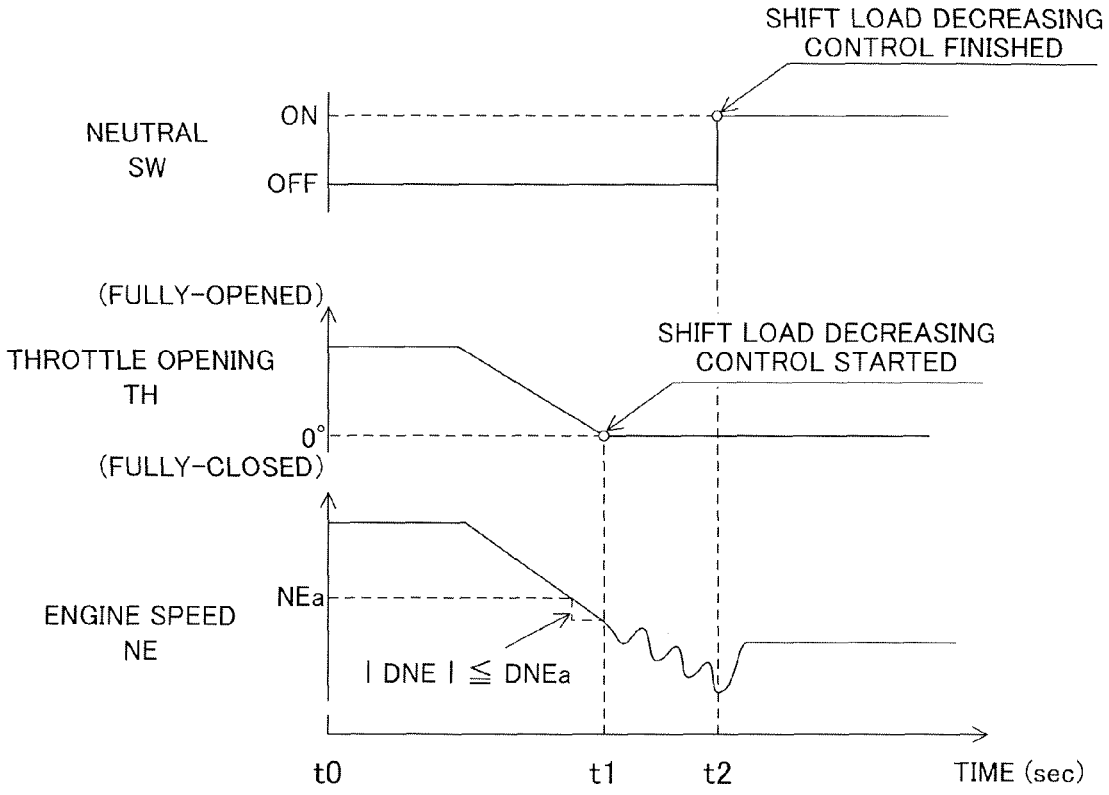
FIG. 6 is a time chart for explaining a part of the processes of the flowcharts in FIGS. 4 and 5.

FIG. 6 is a time chart for explaining a part of the processes of the flowcharts in FIGS. 4 and 5. FIG. 6 shows the case where the shift position is moved from the forward (in-gear) position to the neutral position.

As shown in FIG. 6, from the time t0 to t1, since the neutral switch 96 produces no output (i.e., is made OFF), the shift position is in the forward (in-gear) position (S100).

When the shift lever 22 is manipulated from the forward to the neutral and at the time t1, the throttle opening TH is at the fully-closed position or thereabout (S106), the engine speed NE is equal to or less than the predetermined engine speed NEa (S110) and the absolute value of the engine speed change amount DNE is equal to or less than the predetermined value DNEa (S114), it is estimated to be at the timing of shift position change from the in-gear position to the neutral position, i.e., to be immediately before the engagement of the clutch 74 with the forward gear is released, and the shift load decreasing control to decrease the driving force of the engine 44 is started (S116). As a result, the engine speed NE is changed and gradually decreased and it makes easy to release the engagement of the clutch 74 with the forward gear 70, thereby mitigating the load on the operator caused by the shift lever manipulation.

Next the shift lever 22 is further manipulated to the neutral. When, at the time t2, the neutral switch 96 produces the output (ON signal), i.e., when the shift position has been switched to the neutral position, the shift load decreasing control is finished (S100, S138).

Although not illustrated, in the case where the shift load decreasing control is executed the predetermined number of times or more before the neutral switch 96 is made ON at the time t2, i.e. between the time t1 and t2, the shift load decreasing control is finished (S132, S136).

As stated above, the embodiment is configured to have an apparatus or method for controlling operation of an outboard motor (10) having a shift lever (22) used to change a shift position between an in-gear position (forward or reverse position) that enables driving force of an internal combustion engine (44) to be transmitted to a propeller (62) by engaging a clutch (74) with one of a forward gear (70) and a reverse gear (72) and a neutral position that cuts off transmission of the driving force by disengaging the clutch from the forward or reverse gear, comprising: a throttle opening detector (ECU 26, throttle opening sensor 92, S10) adapted to detect a throttle opening TH of the engine; an engine speed detector (ECU 26, crank angle sensor 94, S108) adapted to detect a speed NE of the engine; an engine speed change amount calculator (ECU 26, S112) adapted to calculate a change amount (DNE) of the detected engine speed; and a driving force decreasing controller (ECU 26, S106, S110, S114, S116) adapted to conduct driving force decreasing control to decrease the driving force of the engine based on the detected throttle opening, the detected engine speed and the calculated engine speed change amount.

With this, it becomes possible to decrease the driving force of the engine 44 at the appropriate timing, thereby mitigating the load on the operator caused by the shift lever manipulation. Specifically, the timing of shift position change from the in-gear position to the neutral position can be accurately detected based on the throttle opening TH, engine speed NE and engine speed change amount DNE and since the driving force decreasing control is started at the detected timing, i.e., at the appropriate timing, it makes easy to release the engagement of the clutch 74 with the forward or reverse gear 70 or 72 (in-gear condition), thereby effectively mitigating the shift lever manipulation load. Further, since a switch or sensor for detecting the manipulation of the shift lever 22 by the operator is not necessary, the degree of freedom of layout can be enhanced and also it is advantageous in the cost.

In the apparatus or method, the driving force decreasing controller conducts the driving force decreasing control when the detected throttle opening is at a fully-closed position or thereabout, the detected engine speed is equal to or less than a predetermined engine speed (NEa) and the calculated change amount is equal to or less than a predetermined value (DNEa) (S106, S110, S114, S116). With this, the timing of shift position change from the in-gear position to the neutral position can be more accurately detected and since the driving force decreasing control is started at the detected timing, it becomes possible to effectively mitigate the shift lever manipulation load.

In the apparatus or method, the driving force decreasing controller stops the driving force decreasing control when the driving force decreasing control is conducted a predetermined number of times or more or when the shift position is changed to the neutral position (S100, S130, S132, S136, S138).

Thus, since it is configured so that the driving force decreasing controller stops the driving force decreasing control when it is conducted the predetermined number of times or more, even when, for instance, the shift lever 22 is slowly manipulated from the in-gear position to the neutral position, the driving force decreasing control can be finished before the engine 44 operation becomes unstable, i.e., it makes possible to avoid longer execution of the driving force decreasing control than necessary. In other words, the driving force decreasing control can be appropriately conducted, while avoiding unstable operation of the engine 44.

Further, since the driving force decreasing controller stops the driving force decreasing control when the shift position has been switched to the neutral position, i.e., at the timing when the driving force decreasing control is no longer required, the driving force decreasing control can be conducted more appropriately.

In the apparatus or method, the driving force decreasing controller decreases the driving force of the engine by conducting at least one of ignition cut-off, ignition timing retarding and decrease of a fuel injection amount in the engine (S116). With this, it becomes possible to reliably decrease the driving force of the engine 44 and effectively mitigate the shift lever manipulation load.

It should be noted that, although the outboard motor is taken as an example, this invention can be applied to an inboard/outboard motor. Further, although the predetermined engine speed NEa, predetermined value DNEa, predetermined number of times, displacement of the engine 44 and other values are indicated with specific values in the foregoing, they are only examples and not limited thereto.

Japanese Patent Application No. 2011-112259, filed on May 19, 2011, is incorporated by reference herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An apparatus for controlling operation of an outboard motor having a shift lever used to change a shift position between an in-gear position that enables driving force of an internal combustion engine to be transmitted to a propeller by engaging a clutch with one of a forward gear and a reverse gear and a neutral position that cuts off transmission of the driving force by disengaging the clutch from the forward or reverse gear, comprising:

a throttle opening detector adapted to detect a throttle opening of the engine;

an engine speed detector adapted to detect a speed of the engine;

an engine speed change amount calculator adapted to calculate a change amount of the detected engine speed; and a driving force decreasing controller adapted to conduct driving force decreasing control to decrease the driving force of the engine based on the detected throttle opening, the detected engine speed and the calculated engine speed change amount, wherein the driving force decreasing controller conducts the driving force decreasing control when the detected throttle opening is at a fully-closed position or thereabout, the detected engine speed is equal to or less than a predetermined engine speed and the calculated change amount is equal to or less than a predetermined value.

2. The apparatus according to claim 1, wherein the driving force decreasing controller stops the driving force decreasing control when the driving force decreasing control is conducted a predetermined number of times or more or when the shift position is changed to the neutral position.

3. The apparatus according to claim 1, wherein the driving force decreasing controller decreases the driving force of the engine by conducting at least one of ignition cut-off, ignition timing retarding and decrease of a fuel injection amount in the engine.

4. An apparatus for controlling operation of an outboard motor having a shift lever used to change a shift position between an in-gear position that enables driving force of an internal combustion engine to be transmitted to a propeller by engaging a clutch with one of a forward gear and a reverse gear and a neutral position that cuts off transmission of the driving force by disengaging the clutch from the forward or reverse gear, comprising:

throttle opening detecting means for detecting a throttle opening of the engine;

engine speed detecting means for detecting a speed of the engine;

engine speed change amount calculating means for calculating a change amount of the detected engine speed; and driving force decreasing controlling means for conducting driving force decreasing control to decrease the driving force of the engine based on the detected throttle opening, the detected engine speed and the calculated engine speed change amount, wherein the driving force decreasing controlling means conducts the driving force decreasing control when the detected throttle opening is at a fully-closed position or thereabout, the detected engine speed is equal to or less than a predetermined engine speed and the calculated change amount is equal to or less than a predetermined value.

5. The apparatus according to claim 4, wherein the driving force decreasing controlling means stops the driving force decreasing control when the driving force decreasing control is conducted a predetermined number of times or more or when the shift position is changed to the neutral position.

6. The apparatus according to claim 4, wherein the driving force decreasing controlling means decreases the driving force of the engine by conducting at least one of ignition cut-off, ignition timing retarding and decrease of a fuel injection amount in the engine.

7. A method for controlling operation of an outboard motor having a shift lever used to change a shift position between an in-gear position that enables driving force of an internal combustion engine to be transmitted to a propeller by engaging a clutch with one of a forward gear and a reverse gear and a neutral position that cuts off transmission of the driving force by disengaging the clutch from the forward or reverse gear, comprising the steps of:

detecting a throttle opening of the engine;

detecting a speed of the engine;

calculating a change amount of the detected engine speed; and conducting driving force decreasing control to decrease the driving force of the engine based on the detected throttle opening, the detected engine speed and the calculated engine speed change amount, wherein the step of conducting conducts the driving force decreasing control when the detected throttle opening is at a fully-closed position or thereabout, the detected engine speed is equal to or less than a predetermined engine speed and the calculated change amount is equal to or less than a predetermined value.

8. The method according to claim 7, wherein the step of conducting stops the driving force decreasing control when the driving force decreasing control is conducted a predetermined number of times or more or when the shift position is changed to the neutral position.

9. The method according to claim 7, wherein the step of conducting decreases the driving force of the engine by conducting at least one of ignition cut-off, ignition timing retarding and decrease of a fuel injection amount in the engine.

* * * * *